US010539136B2

(12) United States Patent
Weigl et al.

(10) Patent No.: US 10,539,136 B2
(45) Date of Patent: Jan. 21, 2020

(54) ROTARY PISTON PUMP, METHOD FOR FIXING ROTARY PISTONS OF A ROTARY PISTON PUMP AND METHOD FOR DISMANTLING ROTARY PISTONS OF A ROTARY PISTON PUMP

(71) Applicant: NETZSCH Pumpen & Systeme GmbH, Selb (DE)

(72) Inventors: Stefan Weigl, Muehldorf am Inn (DE); Franz Kneidl, Waldkraiburg (DE); Thomas Schmitt, Lohkirchen (DE); Achim Dehnz, Söchtenau (DE); Dominik Hindera, Winhöring (DE); Mathias Obermaier, Waldkraiburg (DE); Markus Rosam, Aschau am Inn (DE); Erwin Weber, Waldkraiburg (DE)

(73) Assignee: NETZSCH Pumpen & Systeme GmbH, Selb (DE)

( * ) Notice: Subject to any disclaimer, the term of this patent is extended or adjusted under 35 U.S.C. 154(b) by 292 days.

(21) Appl. No.: 15/516,309

(22) PCT Filed: Nov. 20, 2015

(86) PCT No.: PCT/DE2015/000552
§ 371 (c)(1),
(2) Date: Mar. 31, 2017

(87) PCT Pub. No.: WO2016/082814
PCT Pub. Date: Jun. 2, 2016

(65) Prior Publication Data

US 2017/0306949 A1 Oct. 26, 2017

(30) Foreign Application Priority Data

Nov. 24, 2014 (DE) ..... 10 2014 117 166

(51) Int. Cl.
*F01C 1/14* (2006.01)
*F01C 1/24* (2006.01)
(Continued)

(52) U.S. Cl.
CPC ..... *F04C 15/0073* (2013.01); *F04C 2/126* (2013.01); *F04C 15/0076* (2013.01);
(Continued)

(58) Field of Classification Search
CPC .. F04C 2/126; F04C 15/0061; F04C 15/0073; F04C 15/0076; F04C 2230/70; F04C 2230/60
(Continued)

(56) References Cited

U.S. PATENT DOCUMENTS 4,293,290 A * 10/1981 Swanson ..... F04C 2/126 418/206.7
5,370,514 A * 12/1994 Morita ..... F04C 15/0076 418/206.1
(Continued)

FOREIGN PATENT DOCUMENTS

DE 19806657 A1 9/1999
DE 102009029296 A1 3/2011
(Continued)

OTHER PUBLICATIONS

German International Search Report (w/ Translation) Application No. PCT/DE2015/000552 Completed Date: Feb. 25, 2016; dated Mar. 4, 2016 5 Pages.

*Primary Examiner* — Theresa Trieu
(74) *Attorney, Agent, or Firm* — Whitmyer IP Group LLC

(57) ABSTRACT

A method for fixing rotary pistons in a rotary piston pump and a method for dismantling rotary pistons of a rotary piston pump, where the rotary piston pump has two counter-rotating rotary arranged in a pump space on drive shafts. The
(Continued)

rotary pistons each include a seating for the drive shafts. The respective drive shaft is arranged and fixed with an end region in the seating of the respective rotary piston. A diameter of the drive shafts in the end region can be widened elastically. In an operational state, in which the rotary pistons are arranged on the respective drive shafts, a frictional connection is formed between the respective seating of the rotary piston and the end region of the respective drive shaft.

17 Claims, 2 Drawing Sheets

(51) Int. Cl.

| | |
|---|---|
| ***F03C 2/00*** | (2006.01) |
| ***F04C 2/00*** | (2006.01) |
| ***F04C 15/00*** | (2006.01) |
| ***F04C 2/12*** | (2006.01) |

(52) U.S. Cl.
CPC ..... *F04C 15/0061* (2013.01); *F04C 2230/60* (2013.01); *F04C 2230/70* (2013.01)

(58) Field of Classification Search
USPC ..... 418/188, 206.1–206.9, 1
See application file for complete search history.

(56) References Cited

U.S. PATENT DOCUMENTS

| | | | | |
|---|---|---|---|---|
| 2008/0069707 | A1* | 3/2008 | Van Norman ..... | F04C 15/0076 418/206.1 |
| 2010/0019427 | A1* | 1/2010 | Nishida ..... | B23Q 16/102 269/74 |
| 2012/0267446 | A1* | 10/2012 | Stiegler ..... | F04C 2/14 239/11 |
| 2014/0348687 | A1* | 11/2014 | Weigl ..... | F04C 2/18 418/206.6 |

FOREIGN PATENT DOCUMENTS

| | | | | |
|---|---|---|---|---|
| DE | 102012003066 | B3 | | 7/2013 |
| DE | 102013101185 | A1 | | 8/2013 |
| EP | 0577064 | A1 | | 1/1994 |
| JP | S61149615 | A | | 7/1986 |
| JP | 6336723 | U | * | 9/1988 |
| JP | 09317779 | A | * | 12/1997 |

* cited by examiner

ROTARY PISTON PUMP, METHOD FOR FIXING ROTARY PISTONS OF A ROTARY PISTON PUMP AND METHOD FOR DISMANTLING ROTARY PISTONS OF A ROTARY PISTON PUMP

TECHNICAL FIELD

The present invention relates to a rotary piston pump, a method for fixing rotary pistons of an aforementioned rotary piston pump and a method for dismantling rotary pistons of an aforementioned rotary piston pump according to the features of the invention.

BACKGROUND

The present application relates to the fixing of rotary pistons of a rotary piston pump on the respective drive shaft.

Rotary piston pumps are self-priming or conditionally self-priming valveless positive displacement pumps with rotary pistons engaging into one another. In particular, rotary piston pumps comprise at least two counter-rotating double- or multi-lobe rotary pistons, the drive shafts whereof comprise seals. Rotary piston pumps preferably comprise two drive shafts for two rotary pistons.

According to DE 19806657, the drive shafts are provided at their end arranged in the pump space with screw joints for fastening to the rotary pistons. The drive shafts are each constituted in one piece and remain in the pump housing during the assembly or dismantling of the rotary pistons. Provision is made here such that one of the drive shafts is connected via a coupling to the drive and is freely rotatable with respect to the other drive shaft in the uncoupled state.

DE 102012003066 B3 describes a method and a device for fixing and synchronising rotary pistons of a rotary piston pump. Here, the rotary pistons are introduced in the pump space. A shaft stub of each rotary piston is pushed through the pump rear wall onto the respective drive shaft. The rotary pistons are aligned and synchronised in the pump space by means of a template. The template is fixed detachably to the pump housing in this alignment step. The shaft stubs of the aligned rotary pistons are each connected by means of a clamping device in a friction-locked manner to the respective drive shaft outside the pump space.

DE 102013101185 A1 discloses a rotary piston pump, wherein the seals are arranged on a shaft shoulder of the respective rotary piston and one slip ring per seal is provided with a locking device, which comprises a multiplicity of fixing positions. The seal with the locking device is pushed onto the tubular shaft shoulder and the shaft shoulder of each rotary piston is pushed through the pump rear wall onto the respective drive shaft. By rotating the rotary piston, a securing element is connected in a form-fit manner in axial grooves of the locking device. The shaft shoulder and therefore the rotary piston are then connected by a clamping device in a friction-locked manner to the respective drive shaft outside the pump space.

The problem of the invention is to fix the rotary pistons of a rotary piston pump easily and quickly on the respective drive shaft, so that torques and axial forces are transmitted play-free from the drive shaft into the rotary piston.

The above problem is solved by a rotary piston pump, a method for fixing rotary pistons of an aforementioned rotary piston pump and a method for dismantling rotary pistons of an aforementioned rotary piston pump, according to the invention.

SUMMARY

The invention relates to a rotary piston pump with at least two counter-rotating rotary pistons arranged in a pump space on drive shafts. A contact is always present between the rotary pistons and a pump housing surrounding the pump space, wherein pump chambers are constituted between the rotary pistons and the pump housing. The product to be delivered is sucked through the pump chambers, conveyed through the rotary piston pump and expelled at the opposite side of the pump.

According to the invention, a diameter of the drive shafts in the end region can be widened elastically. In an operational state, in which the rotary pistons are arranged non-rotatably on the respective drive shafts, a frictional connection is formed between the respective seating of the rotary piston and the end region of the respective drive shaft. A play-free power transmission can thus take place. In a state of change, in which for example maintenance work is carried out on the rotary piston pump and the rotary pistons have to be removed from the drive shafts for this purpose, this frictional connection is on the other hand removed. According to another embodiment, in the operational state in which the rotary pistons are arranged non-rotatably on the respective drive shafts, a frictional and form-fit connection is formed between the respective seating of the rotary piston and the end region of the respective drive shaft. In a state of change, in which for example maintenance work is carried out on the rotary piston pump and the rotary pistons have to be removed from the drive shafts for this purpose, this frictional and form-fit connection is on the other hand removed.

The fixing of rotary pistons to drive shafts of an aforementioned rotary piston pump takes place in the following process steps: The rotary pistons are pushed onto the respective drive shafts, so that the end region of the respective drive shaft is arranged in the seating of the respective rotary piston. A clearance is formed between the drive shaft and the seating at this time, so that the rotary pistons can be aligned arbitrarily on the respective drive shafts. According to an embodiment of the invention, the alignment of the rotary pistons pushed onto the drive shafts takes place simultaneously by means of a template, similar to the prior art described in DE 102012003066.

The end regions of the drive shafts are then each widened, so that a frictional connection is produced between the seating of the rotary piston and the end region of the drive shaft. The non-rotatable fixing of the rotary pistons on the drive shafts thus takes place.

For dismantling, for example for maintenance work on the rotary piston pump or suchlike, the frictional connection between the seating of the rotary piston and the end region of the drive shaft is removed or released by reducing a diameter of the end region of the drive shaft, so that the rotary pistons can easily be removed from the drive shafts.

According to a preferred embodiment of the invention, a gripping and/or clamping device for fixing the rotary pistons by means of a frictional connection to the respective drive shaft is assigned to the end region of the drive shaft and/or to the seating of the rotary piston. Within the scope of the present invention, the rotary piston is fixed to the respective drive shaft by adjusting the gripping and/or clamping device, in such a way that torques or axial forces are transmitted play-free from the drive shaft into the rotary piston. This operative connection is removed by loosening the gripping and/or clamping device, so that no transmission of torques and axial forces from the drive shaft into the rotary piston takes place.

The gripping of the rotary piston with the drive shaft can take place in various ways. For example, mechanical elements can be inserted into the drive shaft or hydraulic and/or pneumatic elements can also be incorporated.

For example, the gripping and/or clamping device according to an embodiment of the invention comprises size-variable hydraulic and/or pneumatic elements. By filling a suitable hydraulic fluid and/or a suitable gas into the gripping and/or clamping device, and by putting the employed fluid under pressure, the outer diameter of the drive shaft is widened in the end region arranged in the pump space inside the seating. Correspondingly, the outer diameter of the end region of the drive shaft is reduced in size by removing the pressure from the fluid, i.e. from the hydraulic fluid and/or the gas, from the gripping and/or clamping device of a fixed drive shaft/rotary piston arrangement, so that it now again corresponds to an initial outer diameter along the longitudinal axis of the drive shaft and a clearance is thus again formed between the end region of the drive shaft and the seating of the rotary piston.

According to a further embodiment of the invention, the gripping and/or clamping device comprises so-called conical elements as mechanical elements. The outer diameter of the end region is widened or increased in size by displacing the conical elements in a first movement direction in the region of the seating of the rotary piston and/or by displacing the conical elements inside the end region of the drive shaft arranged in the pump space inside the seating of the rotary piston, so that the end region of the drive shaft is fixed firmly in the seating of the rotary piston. Correspondingly, the widened outer diameter in the end region of the drive shaft is reduced again to the original first outer diameter by displacing the conical elements in a second, opposite direction, so that the frictional connection between the rotary piston and the drive shaft is removed and the rotary piston can readily be removed from the drive shaft.

According to an embodiment of the invention, the drive shafts are constituted in each case as hollow shafts with a continuous hollow space along their respective longitudinal axis. The rotary pistons each comprise on the lateral surface, which is assigned to the free end of the drive shaft projecting into the pump space, a seating for the end region of the respective drive shafts arranged in the pump space. The hollow space in the end region of the respective drive shaft arranged in the pump space has a widened cross-section, i.e. the drive shafts are each constituted in a more slender form in the region of the rotary piston seat. In particular, the respective hollow space in the end region of the respective drive shaft arranged in the pump space has a widened cross-section with at least one second inner diameter which is greater than the first inner diameter of the continuous hollow space along the longitudinal axis of the drive shaft. The drive shafts of the rotary piston pump preferably have a first outer diameter along their respective longitudinal axis. This first outer diameter can be made wider or larger in the end region of the drive shafts arranged in the pump space in each case by means of the gripping and/or clamping device, so that the end region of the drive shafts is in each case fixed firmly, in particular gripped or clamped, in the respective seating of the rotary pistons.

In particular, it is possible to press the drive shaft in the end region of the widened cross-section from the inside outwards against the inner side of the rotary piston and thus to transmit the torques and axial forces play-free from the drive shaft into the rotary piston. A gripping and/or clamping device already described above for fixing the rotary pistons to the respective drive shaft is assigned for this purpose to the widened hollow space of the drive shaft and/or the seating of the rotary piston.

According to a preferred embodiment of the invention, provision is made such that a tool for acting on the gripping and/or clamping device can be introduced through the continuous hollow space along the respective longitudinal axis of the drive shafts, in particular a tool for fixing or releasing the gripping and/or clamping device.

For maintenance work, for example, a tool is introduced through the hollow space along the respective longitudinal axis of the respective drive shaft, with which tool the fixing of the rotary pistons to the respective drive shaft is released. The tool is preferably removed from the hollow space, but can also remain in the hollow space during the maintenance work, as long as this does not interfere with the further work steps. The rotary pistons and the respective sealing elements can now be removed from the respective drive shaft and, after completion of the maintenance work, can again be fixed by means of the tool.

In particular, the gripping and/or clamping device is adjusted by means of the tool introduced through the hollow space in such a way that the outer diameter in the end region of the drive shaft is widened or enlarged. For dismantling, the gripping and/or clamping device is released by means of the tool introduced through the hollow space, so that the outer diameter in the end region again corresponds to the first outer diameter along the longitudinal axis of the drive shaft and a clearance is thus again formed between the end region of the drive shaft and the seating of the rotary piston.

The method for assembling or dismantling rotary pistons of a rotary piston pump can, as an alternative or in addition to the described features, comprise one or more features and/or properties of the previously described device. Likewise, the device can, alternatively or in addition, comprise individual ones or a plurality of the features and/or properties of the described method.

A particular advantage over the previously known prior art is that the pistons do not have to be fastened with a plurality of screws via the rear side of the pump housing, but on the contrary only a fixing via a fixing point is required and no screws whatsoever or other elements have to be incorporated in the pump space.

BRIEF DESCRIPTION OF THE DRAWINGS

Examples of embodiment of the invention and its advantages are explained in greater detail below with the aid of the appended figures. The size ratios of the individual elements with respect to one another in the figures do not always correspond to the actual size ratios, since some forms are represented simplified and other forms magnified compared with other elements for the sake of better clarity.

DETAILED DESCRIPTION

Identical reference numbers are used for identical or identically acting elements of the invention. Furthermore, for the sake of a clearer view, only reference numbers are represented in the individual figures that are required for the description of the respective figure. The represented embodiments only represent examples as to how the device according to the invention or the method according to the invention can be constituted and do not represent a conclusive limitation.

Figure 1:
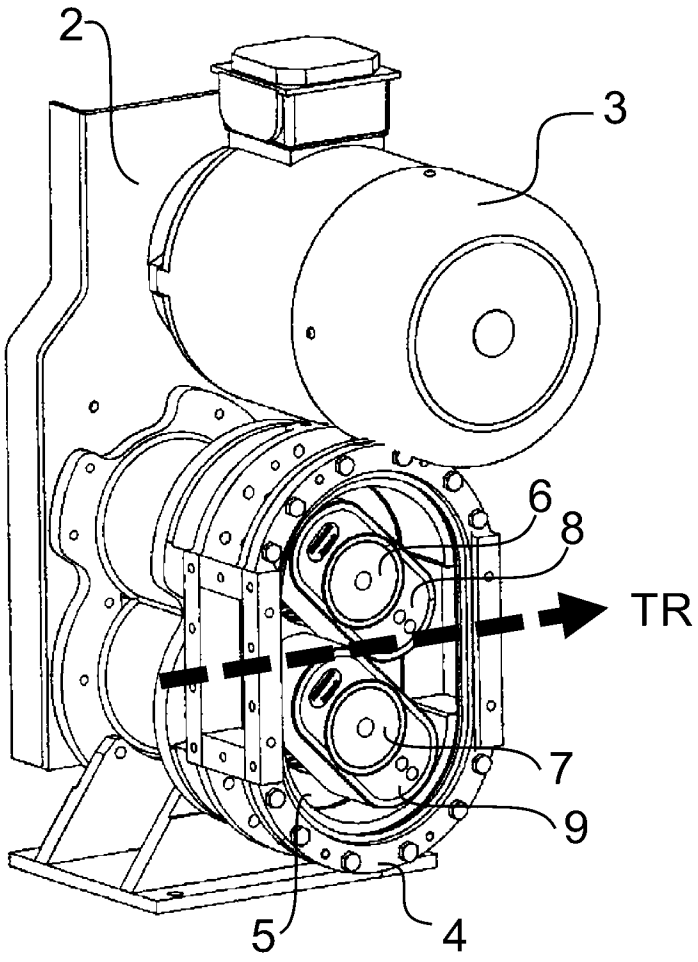
(Prior Art) Fig. 1
FIG. 1 shows a diagrammatic view of a rotary piston pump according to the known prior art.

FIG. 1 shows a diagrammatic view of a rotary piston pump 1 with two rotary pistons 8, 9 according to the known prior art. A motor 3 is arranged on a machine stand. This motor drives two drive shafts 6, 7 in opposite directions. Rotary pistons 8, 9 are arranged respectively on the drive shafts in a pump housing 4, said rotary pistons being driven via drive shafts 6, 7 and rotating simultaneously and in opposite directions around the axes of drive shafts 6, 7. During the rotation of rotary pistons 8, 9, there is always contact between rotary pistons 8, 9 and pump housing 4 of rotary piston pump 1. The product to be delivered is sucked through pump chambers 5 thus being formed, conveyed in transport direction TR through rotary piston pump 1 and expelled at the opposite side of the pump. Seals (not represented) are arranged on drive shafts 6, 7 in order to seal the pump space with respect to the surroundings.

Figure 3:
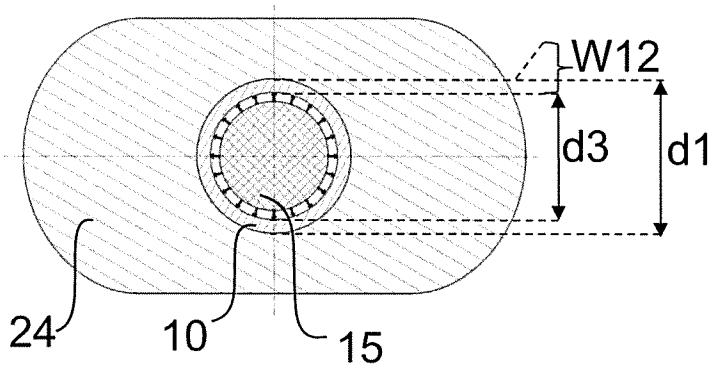
FIG. 3 shows a cross-sectional representation of the first embodiment of the fastening of the rotary piston to a drive shaft according to FIG. 2 along a cross-sectional line A-A.
Figure 2:
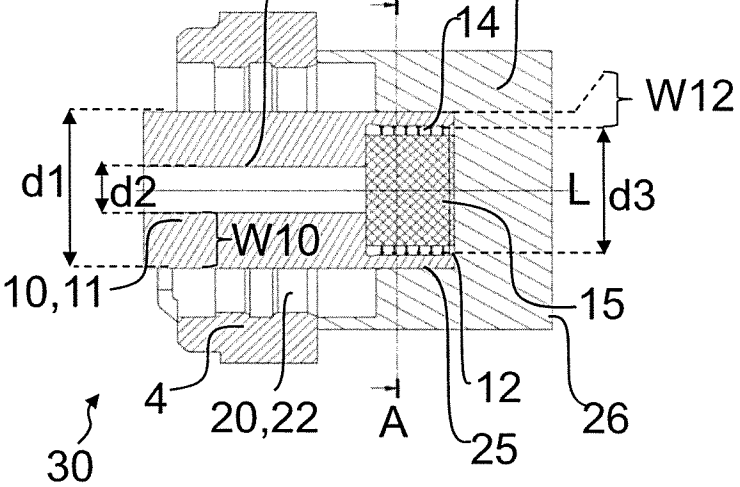
FIG. 2 shows a first embodiment of a fastening device for fastening a rotary piston on a drive shaft.

FIG. 2 shows a first partial view of a first embodiment of a rotary piston pump 30 constituted according to the invention with a fastening of a rotary piston 24 on a specially constituted drive shaft 10 and FIG. 3 shows a cross-sectional representation of the first embodiment of the fastening of a rotary piston 24 on a drive shaft 10 according to FIG. 2 along a cross-sectional line A-A.

In the region of the passage of drive shaft 10 through pump housing 4, an installation space 20 is provided for slip-ring seals 22 or other suitable sealing elements for sealing the pump space with respect to the surroundings. Rotary piston 24 is arranged on end region 12 of drive shaft 10 that lies opposite to the drive side of drive shaft 10. In particular, a seating 25 with a circular cross-section for the seating of drive shafts 10 is provided on rotary piston 24. The fastening of rotary piston 24 to drive shaft 10 takes place with the aid of a gripping device 15 assigned to end region 12 of drive shaft 10.

The drive shaft 10 is constituted as a so-called hollow shaft 11. In particular, a first hollow space 13 extends along longitudinal axis L of drive shaft 10. Hollow shaft 11 has an outer diameter d1 over its entire length. Furthermore, hollow shaft 11 has in sections a first inner diameter d2, which defines first hollow space 13.

The drive shaft 10 is constituted in a more slender form in end region 12, i.e. in the region in which rotary piston 24 sits via seating 25 on drive shaft 10. In particular, a second widened hollow space 14 with a second inner diameter d3 is provided in end region 12 of drive shaft 10. It is the case that outer diameter d1 of drive shaft 10 is greater than second inner diameter d3 of widened, second hollow space 14 in end region 12 of drive shaft 10 and the latter is in turn greater than first inner diameter d2 of first hollow space 13 along longitudinal axis L of drive shaft 10.

As a result of the widening of second hollow space 14 in end region 12 of drive shaft 10, wall thickness W12 in this region is smaller than general wall thickness W10 of drive shaft 10. In particular, general wall thickness W10 is calculated from 0.5 times the difference between outer diameter d1 and first inner diameter d2:

$$W10=0.5*(d1-d2).$$

Resultant wall thickness W12 in end region 12 of drive shaft 10 is calculated from 0.5 times the difference between outer diameter d1 and second inner diameter d3:

$$W12=0.5*(d1-d3).$$

Seating 25 of rotary piston 24 has an inner diameter which largely corresponds to outer diameter d1 of drive shaft 10, in particular the inner diameter of seating 25 is slightly greater than outer diameter d1, so that rotary piston 24 sits with a small amount of play on end region 12 of drive shaft 10.

On account of reduced wall thickness W12 of drive shaft 10, it is possible to press drive shaft 10 in end region 12 from the inside outwards against seating 25 of rotary piston 24. This leads to a non-rotatable fixing of drive shaft 10 in seating 25 of rotary piston 24. It is thus possible to transmit torques and axial forces play-free from drive shaft 10 into rotary piston 24.

The gripping of rotary piston 24 at end region 12 of drive shaft 10 can take place in various ways. Examples of this are represented in FIGS. 2 to 5. Conical elements can for example be inserted into drive shaft 10 (see FIGS. 4 and 5), or hydraulic and/or pneumatic elements (see FIGS. 2 and 3) can also be used.

According to the represented embodiment, rotary piston 24 is closed at side 26 facing away from drive shaft 10. Rotary piston 24 is preferably pushed onto drive shaft 10, so that end region 12 of drive shaft 10 is seated at least partially in seating 25 of rotary piston 24.

The installation of rotary piston 24 in rotary piston pump 30 according to the invention takes place in the following process steps according to a preferred embodiment of the invention: a slip-ring seal 22 is first pushed in each case onto drive shafts 10, a rotary piston 24 then being pushed in each case onto drive shafts 10. Rotary pistons 24 are aligned. For this purpose, use is made for example of a template similar to the prior art described in DE 102012003066 B3 and in DE 102013101185 A1. A tool is then introduced through hollow space 13 from the drive side of drive shafts 10 and rotary pistons 24 are fixed to respective shaft 10 by tightening up/screwing down gripping device 15.

According to an embodiment of the invention, gripping device 15 is arranged in seating 25 of rotary piston 24. When rotary piston 24 is pushed onto drive shaft 10, gripping device 15 is pushed into second, widened hollow space 14 of end region 12 of drive shaft 10.

According to an alternative embodiment, gripping device 15 is arranged in second, widened hollow space 14 of end region 12 of drive shaft 10, so that rotary piston 24 is simultaneously pushed onto drive shaft 10 and gripping device 15.

Figure 4:
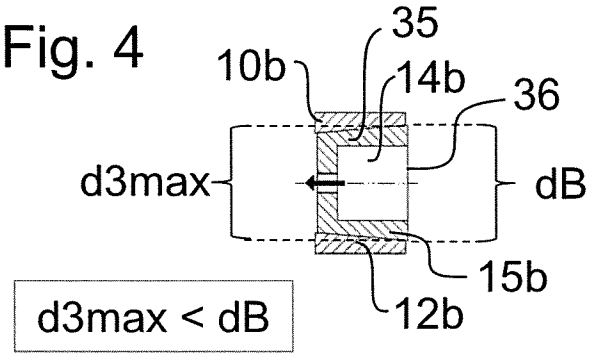
FIG. 4 shows a second embodiment of a fastening device for fastening a rotary piston on a drive shaft.

FIG. 4 shows a second embodiment of a fastening device for fastening a rotary piston (not represented) on a drive shaft 10*b*. Provision is made here such that widened hollow space 14*b* in end region 12*b* widens conically in the direction of the rotary piston. Gripping means 15*b* is constituted as a cone or truncated cone 35, wherein the cross-section of cone or truncated cone 35 tapers away from the rotary piston. Cone or truncated cone 35 has an outer diameter dB in the region of its bottom face 36, which is at least slightly greater than greatest inner diameter d3max of widened hollow space 14*b*. For the fixing of the rotary piston (not represented) to drive shaft 10*b*, truncated cone 36 is pushed or drawn, with the aid of a suitable tool, farther into widened hollow space 14*b* of drive shaft 10. This leads to a widening of outer diameter d1 (see FIG. 2) of drive shaft 10*b* and therefore to gripping of rotary piston 24 in seating 25 (see FIG. 2).

Figure 5:
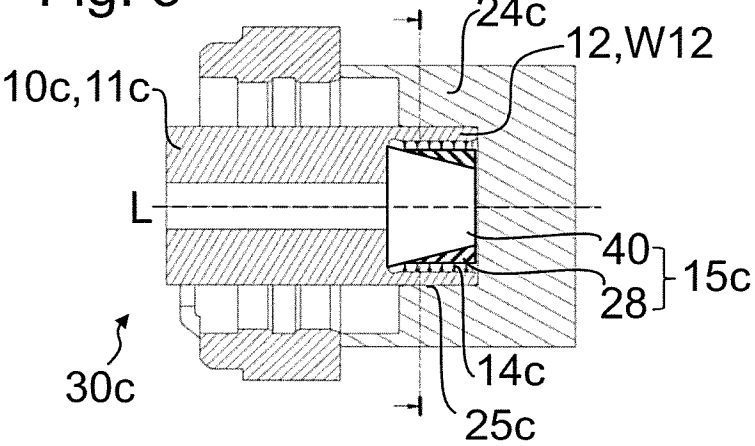
FIG. 5 shows a third embodiment of a fastening device for fastening a rotary piston on a drive shaft.

FIG. 5 shows a third embodiment of a fastening device for fastening a rotary piston 24*c* on a drive shaft 10*c* of a rotary piston pump 30*c*. Gripping means 15*c* is formed here from a conical element 40 incorporated in drive shaft 10*c* and a corresponding conical seating 28 arranged inside seating 25*c* of rotary piston 24*c*.

When rotary piston 24*c* is pushed onto drive shaft 10*c*, conical seating 28 is pushed onto conical element 40 arranged in widened hollow space 14 of end region 12 of drive shaft 10.

Rotary piston 24*c* is drawn, with the aid of a suitable tool, farther onto drive shaft 10*c* for the fixing of rotary piston 24*c* on drive shaft 10*c*. Truncated cone 40 is thus pushed farther into conical seating 28. This leads to an at least partial splaying of conical seating 28. As a result of a transfer of the splaying forces to the wall of drive shaft 10*c* in end region 12 with reduced wall thickness W12, the widening of outer diameter d1 (see FIG. 2) of drive shaft 10*c* is brought about in this region and drive shaft 10*c* is thus gripped in seating 25*c* of rotary piston 24*c* (see also FIG. 2).

The invention has been described by reference to a preferred embodiment. It is however conceivable for the person skilled in the art that modifications or changes to the invention can be made without departing from the scope of protection of the following claims.

The invention claimed is:

1. A rotary piston pump comprising:

at least two counter-rotating rotary pistons arranged in a pump space on drive shafts, wherein each rotary piston comprises a seating and wherein each drive shaft has an end region that is arranged and fixed in the seating of the respective rotary piston, wherein a diameter of each drive shaft in the end region is configured to be widened elastically, and wherein in an operational state, in which the rotary pistons are arranged on the respective drive shafts, a frictional connection or a frictional and form-fit connection is formed between the respective seating of the rotary piston and the end region of the respective drive shaft in response to the diameter of the respective drive shaft being widened, so that a power transmission takes place in a play-free manner.

2. The rotary piston pump according to claim 1, wherein at least one of the rotary pistons includes a gripping device that fixes the rotary piston by means of a frictional connection to the respective drive shaft, the gripping device being disposed at at least one of the end region of the respective drive shaft or the seating of the rotary piston.

3. The rotary piston pump according to claim 2, wherein the gripping device comprises at least one of size-variable hydraulic elements or size-variable pneumatic elements, or wherein the gripping device comprises mechanical elements.

4. The rotary piston pump according to claim 2, wherein each drive shaft is constituted as a hollow shaft with a continuous hollow space with a first inner diameter (d2) along a respective longitudinal axis (L), wherein the hollow space in the end region of the respective drive shaft in the pump space has a widened cross-section with at least one second inner diameter (d3), wherein the at least one second inner diameter (d3) is greater than the first inner diameter (d2).

5. The rotary piston pump according to claim 4, wherein each drive shaft has a first outer diameter (d1) along the respective longitudinal axis (L), wherein the gripping device is configured to widen or enlarge the first outer diameter (d1) in the end region arranged in the pump space.

6. The rotary piston pump according to claim 4, wherein a tool for acting on the gripping device is insertable through the continuous hollow space along the respective longitudinal axis (L) of the drive shafts.

7. The rotary piston pump according to claim 2, wherein the gripping device is a clamping device.

8. A method for fixing at least two counter-rotating rotary pistons to respectively assigned drive shafts in a pump space of a rotary piston pump, the method comprising:

pushing the rotary pistons onto free end regions of the respective drive shafts arranged in the pump space;

aligning the rotary pistons on the respective drive shafts;

widening the end regions of the drive shafts to produce a frictional connection between a seating of the rotary piston and the end region of the respective drive shaft for fixing the rotary piston.

9. The method according to claim 8, wherein the widening of the end region of the respective drive shaft takes place by means of a gripping device assigned to at least one of the end region of the respective drive shaft or the seating of the rotary piston.

10. The method according to claim 9, wherein the gripping device comprises at least one of hydraulic elements or pneumatic elements, wherein the end region of the respective drive shaft is widened inside the seating of the rotary piston by filling at least one of a hydraulic fluid or a gas into the gripping device.

11. The method according to claim 9, wherein the gripping device comprises mechanical elements in the form of conical elements, wherein the end region of the respective drive shaft is widened by displacing the conical elements at least one of in the region of the seating of the rotary piston or inside the end region of the drive shaft arranged in the pump space inside the seating of the rotary piston.

12. The method according to claim 9, wherein the gripping device is adjusted by means of a tool in such a way that an outer diameter (d1) of the end region of the respective drive shaft arranged in the pump space is widened inside the seating of the rotary piston by means of the gripping device and the end region of the drive shaft is clamped detachably inside the seating of the rotary piston.

13. The method according to claim 12, wherein the tool is insertable through a hollow space along a respective longitudinal axis (L) of the respective drive shaft to the gripping device.

14. The method according to claim 9, wherein the gripping device is a clamping device.

15. The method according to claim 8, wherein the rotary piston is fixed to the respective drive shaft by adjusting the gripping device, so that torques and axial forces are transmitted play-free from the respective drive shaft into the rotary piston.

16. The method according to claim 8, wherein a diameter of each drive shaft in the end region is configured to be widened elastically and wherein in an operational state, in which the rotary pistons are arranged on the respective drive shafts, the frictional connection is formed between the respective seating of the rotary piston and the end region of the respective drive shaft, so that a power transmission takes place in a play-free manner.

17. A method for dismantling at least two counter-rotating rotary pistons of a rotary piston pump, the rotary pistons being arranged in a pump space on drive shafts, wherein each rotary piston includes a seating and wherein each drive shaft has an end region that is arranged and fixed in the seating of the respective rotary piston, wherein an outer diameter of each drive shaft in the end region is configured to be widened elastically, and wherein in an operational state, in which the rotary pistons are arranged on the respective drive shafts, a frictional connection or a frictional and form-fit connection is formed between the respective seating of the rotary piston and the end region of the respective drive shaft in response to the diameter of the respective drive shaft being widened, so that a power transmission takes place in a play-free manner, the method comprising:

releasing the frictional connection between the seating of the rotary piston and the end region of the drive shaft by reducing the outer diameter of the end region of the drive shaft removing the rotary piston from the respective drive shaft.

* * * * *